US009745774B2

(12) United States Patent
Löw

(10) Patent No.: US 9,745,774 B2
(45) Date of Patent: Aug. 29, 2017

(54) LOCK CYLINDER

(71) Applicant: HUF HÜLSBECK & FÜRST GMBH & CO., Velbert (DE)

(72) Inventor: Matthias Löw, Ratingen (DE)

(73) Assignee: HUF HUSBECK & FURST GMBH & CO. KG, Velbert (DE)

( * ) Notice: Subject to any disclaimer, the term of this patent is extended or adjusted under 35 U.S.C. 154(b) by 0 days.

(21) Appl. No.: 14/164,674

(22) Filed: Jan. 27, 2014

(65) Prior Publication Data

US 2014/0137613 A1 May 22, 2014

Related U.S. Application Data

(63) Continuation of application No. 13/505,691, filed as application No. PCT/DE2010/075123 on Nov. 5, 2010.

(30) Foreign Application Priority Data

Nov. 10, 2009 (DE) ..... 10 2009 052 406
Nov. 5, 2010 (DE) ..... PCT/DE2010/075123

(51) Int. Cl.
*E05B 17/04* (2006.01)
*E05B 15/00* (2006.01)
(Continued)

(52) U.S. Cl.
CPC ..... *E05B 17/045* (2013.01); *E05B 15/0013* (2013.01); *E05B 17/04* (2013.01);
(Continued)

(58) Field of Classification Search
CPC .... E05B 15/0013; E05B 17/04; E05B 17/041; E05B 17/044; E05B 17/045; E05B 17/046
(Continued)

(56) References Cited

U.S. PATENT DOCUMENTS 2,650,492 A * 9/1953 Jacobi ..... 70/490
4,903,512 A * 2/1990 Leroy ..... E05B 17/0058 70/360
(Continued)

FOREIGN PATENT DOCUMENTS

CN 201212291 Y 3/2009
DE 4316223 A1 11/1993
(Continued)

*Primary Examiner* — Christopher Boswell
(74) *Attorney, Agent, or Firm* — Quarles & Brady LLP

(57) ABSTRACT

A lock cylinder includes a housing, in which a sleeve having a cylinder core accommodated therein is rotatably supported. The cylinder core has spring-loaded tumblers forming a form closure with recesses arranged in the sleeve when a key engaging the tumblers is removed. Inside the housing, the sleeve is coupled to a coupling element by means of a disengaging sleeve. The coupling element is supported inside the housing and connected to a bearing in a rotationally-fixed manner. The bearing supports an output element. At least one of the sleeve and the coupling element forms a form closure with the bearing to block the rotation of the output element if an improper object is used in operative connection with the cylinder core.

12 Claims, 5 Drawing Sheets

(51) Int. Cl.
*E05B 27/00* (2006.01)
*E05B 17/00* (2006.01)

(52) U.S. Cl.
CPC ..... *E05B 17/041* (2013.01); *E05B 27/0003* (2013.01); *E05B 17/0058* (2013.01); *Y10T 70/7672* (2015.04); *Y10T 70/8486* (2015.04)

(58) Field of Classification Search
USPC ..... 70/237, 238, 374, 379 R, 380, 379 A, 70/461, 466
See application file for complete search history.

(56) References Cited

U.S. PATENT DOCUMENTS 5,263,348 A * 11/1993 Wittwer ..... 70/379 R
5,295,377 A * 3/1994 Moricz ..... E05B 17/04 70/360
5,732,580 A * 3/1998 Garnault et al. ..... 70/422
6,439,016 B1 * 8/2002 Wittwer et al. ..... 70/379 R
6,978,645 B2 * 12/2005 Shimon ..... E05B 17/0058 70/379 R
7,536,887 B2 * 5/2009 Makino ..... 70/379 R
8,347,677 B2 * 1/2013 Flandrinck ..... 70/379 R
2004/0250579 A1 * 12/2004 Capka et al. ..... 70/492
2008/0168810 A1 7/2008 Flandrinck
2009/0151411 A1 * 6/2009 Um et al. ..... 70/237
2009/0277238 A1 * 11/2009 Flandrinck et al. ..... 70/379 R
2009/0314045 A1 * 12/2009 Giacomin et al. ..... 70/237

FOREIGN PATENT DOCUMENTS

DE 102004032157 A1 1/2006
EP 0647752 A2 4/1995
EP 0769597 A1 4/1997
EP 0943758 A1 9/1999
FR 2748513 A1 11/1997
FR 2882772 A1 9/2006
FR 2895762 A1 7/2007

* cited by examiner

LOCK CYLINDER

CROSS-REFERENCE TO RELATED APPLICATIONS

This application is a continuation of U.S. patent application Ser. No. 13/505,691 filed on May 2, 2012, which claims priority to PCT International Application No. PCT/DE2010/075123 filed on Nov. 5, 2010, which claims priority to German Patent Application No. 10 2009 052 406.1 filed on Nov. 10, 2009, both of which are fully incorporated by reference herein.

STATEMENT REGARDING FEDERALLY SPONSORED RESEARCH OR DEVELOPMENT

Not applicable.

FIELD OF THE INVENTION

The invention relates to a lock cylinder comprising a housing, in which a sleeve having a cylinder core accommodated therein is rotatably mounted and the cylinder core has spring-loaded tumblers which form a form closure with recesses arranged in the sleeve when a key is removed, and within the housing the sleeve is coupled to a coupling element by means of a disengaging sleeve, wherein the coupling element is mounted within the housing and the coupling element is connected in a rotationally fixed manner to a bearing, which bearing serves to support an output element.

BACKGROUND OF THE INVENTION

Lock cylinders having an axial freewheel are known from the prior art. In the lock cylinders disclosed by the prior art, if an improper object is used in operative connection with a lock cylinder, the lock cylinder is decoupled from the bearing. During the decoupling, a cam portion of a coupling element makes its way into a groove present on the housing, so that a rotational movement of an output element configured as an espagnolette is prevented if, for instance, a tool engages the espagnolette in order to forcibly open a lock when the espagnolette is subsequently turned by the tool. In the prior art it is disadvantageous, however, that the groove in the housing, which groove is positively connected to the cam of the disengaging sleeve, for structural reasons adjoins a central center axis of the lock cylinder. The result of this is that, with the aid of the tool which engages the espagnolette, a low force action or applied moment is sufficient to release the positive connection between groove and cam. The resistance moment acting between groove and cam is then insufficient to combat the applied moment acting on the espagnolette, so that the espagnolette can be forcibly rotated in order to open a lock without a proper key.

SUMMARY OF THE INVENTION

The object of the invention is therefore to provide a more secure lock cylinder which prevents forcible opening of a lock by way of an output element of a lock cylinder.

The invention is achieved by virtue of the fact that, if an improper object is used in operative connection with the cylinder core, at least one means is provided, which means forms a form closure with the bearing in order to block rotation of the output element about a longitudinal axis A.

If the bearing is used for a form closure, it is possible to form the form closure at a greater distance from the center axis of the lock cylinder. Hence if an improper object, in particular a tool, is used in operative connection with the lock cylinder, a higher force or applied moment than in the prior art is required to make the output element rotate.

In a preferred embodiment of the invention, it is provided that the bearing has at least one recess or opening, which respectively forms the form closure with a cam portion assigned to the means.

According to another preferred embodiment, it is provided that the means form a form closure with the housing. Security can thereby be further enhanced, since the forces on the tool have to be increased in order to undo the form closure between the bearing and the means. The form closure increases the resistance moment of the output element against turning when the tool which engages the output element is used.

The design is very simple and cost-effective if the housing has at least one opening and/or recess, which serves for the form closure with the cam portion assigned to the means.

According to a preferred embodiment of the lock cylinder, the recess is configured as a groove.

The resistance moment of the output element against rotation when a tool engages the output element is increased if a contact surface of the cam portion and a contact surface of the bearing are substantially complementary to each other.

According to a preferred embodiment of the lock cylinder, it is provided that the contact surface of the cam portion and the contact surface of the bearing is respectively configured as an inclined plane.

The lock cylinder is very secure against break-in if the disengaging sleeve is provided as the means. In addition or alternatively, the coupling element is provided as the means.

According to another preferred embodiment of the lock cylinder, it is provided that the output element is configured as an espagnolette.

BRIEF DESCRIPTION OF THE DRAWINGS

In the figures, the invention is represented schematically on the basis of two illustrative embodiments, wherein.

DETAILED DESCRIPTION OF THE EXAMPLE EMBODIMENTS

Figure 1A:
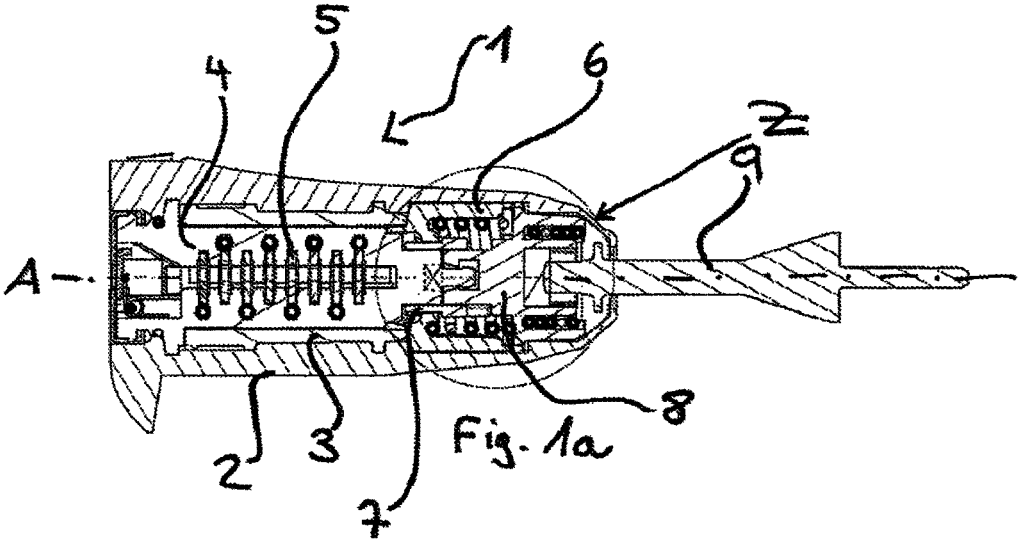
FIG. 1*a* shows a lock cylinder according to a first embodiment in case of a proper use.

A lock cylinder 1 according to a first embodiment is represented in FIGS. 1*a* to 1*c* and 2*a* to 2*c*. In FIG. 1*a*, the lock cylinder 1 is shown in a proper use.

Figure 2A:
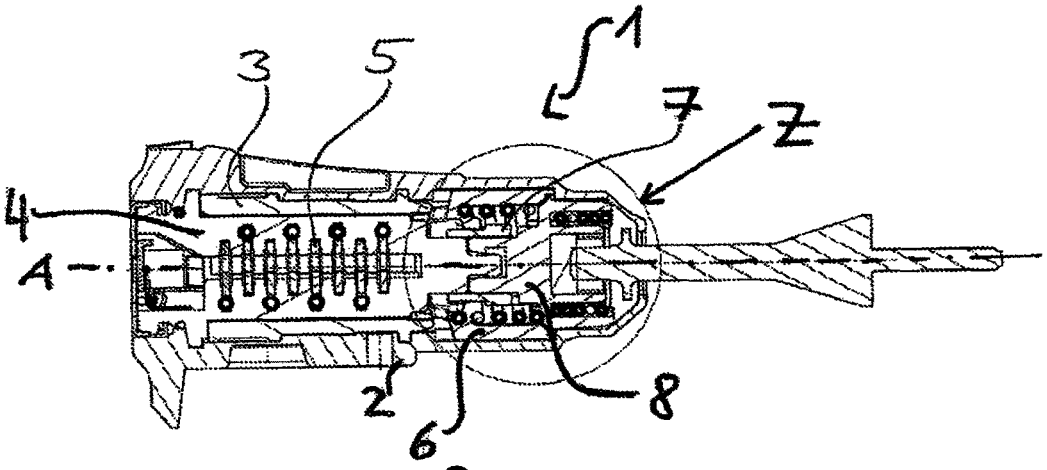
FIG. 2*a* shows the lock cylinder according to the first embodiment in case of an improper use.

A proper use exists if a lock (not shown in detail) operatively connected to the lock cylinder 1 can be opened and closed with a proper key assigned to the lock cylinder 1. In FIG. 2*a*, the lock cylinder 1 according to the first embodiment is shown in an improper use. An improper use exists if the lock (not shown in detail) operatively connected to the lock cylinder 1 is attempted to be opened with a key (incorrect key) not assigned to the lock cylinder 1, or with a tool, in particular with a screwdriver.

The lock cylinder 1 shown in FIGS. 1*a*, 2*a* and 1*b*, 2*b* has a housing 2, in which a metallic sleeve 3 having a cylinder core 4 accommodated therein is rotatably mounted. The cylinder core 4 has spring-loaded tumblers 5, which, when a key (not represented in detail) is removed from the cylinder core 4, form a form closure with recesses (not shown) arranged in the sleeve 3. As shown in FIGS. 1*a*, 1*b*, 1*c*, 2*a*, 2*b*, and 2*c*, the housing is formed from two housing halves joined together along a longitudinal split. Each housing half is shown by a different cross hatching in the figures with the sleeve 3 held between the two joined housing halves.

Within the housing 2, the sleeve 3 is coupled to a coupling element 7 by means of a disengaging sleeve 6. The coupling element 7 is connected via a groove in a rotationally fixed manner to a bearing 8 for the reception of an output element 9 configured to actuate a lock. In the present embodiments, the output element 9 is configured as an espagnolette. Alternatively, the output element could also, however, consist of gearwheels which open and close a lock.

The cylinder core 4 has a pin 10, which engages in a recess 11.1 assigned to the bearing 8. In addition, the bearing 8 has openings 11, which, if the improper object is used in operative connection with the closing cylinder 1, forms a form closure with the disengaging sleeve 6.

Figure 1B:
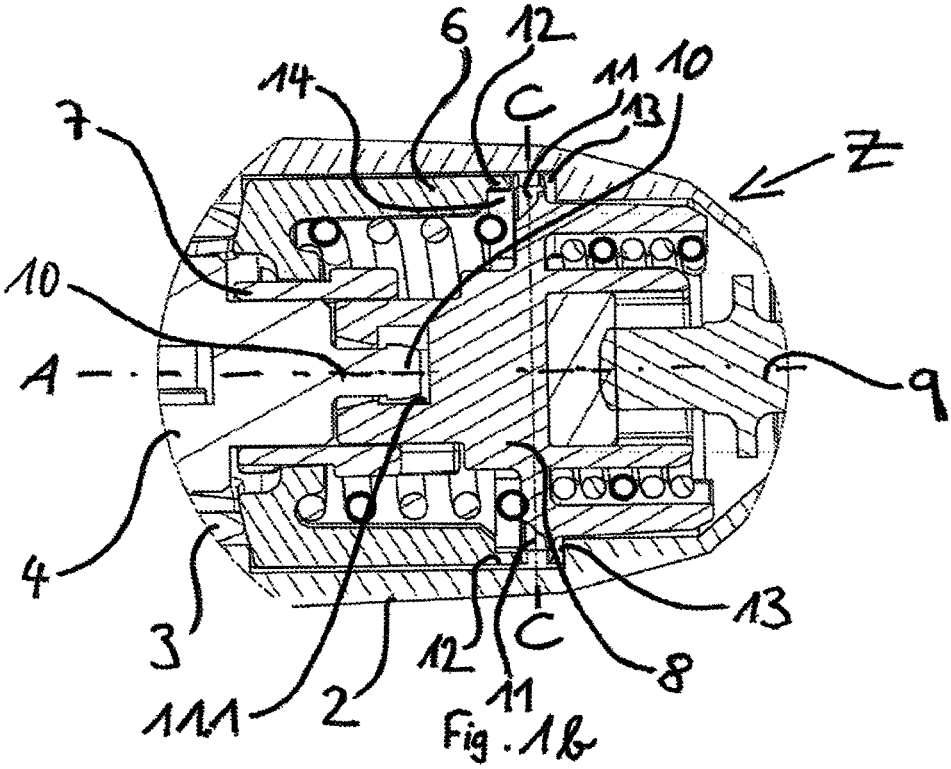
FIG. 1*b* shows an enlarged region Z of the lock cylinder according to the first embodiment.
Figure 1C:
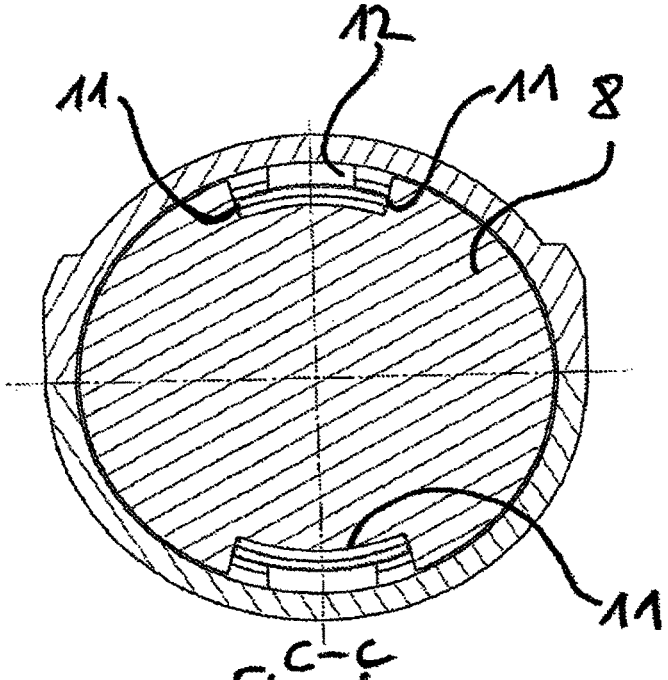
FIG. 1*c* shows the lock cylinder according to the first embodiment sectioned throughline C-C in FIG. 1*b;*
Figure 2B:
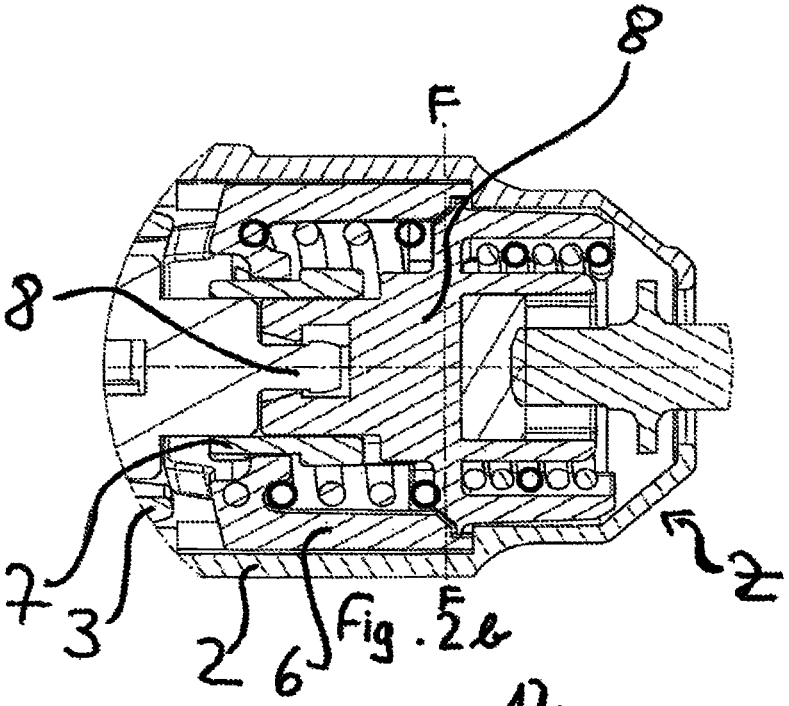
FIG. 2*b* shows the enlarged region Z of the lock cylinder according to the first embodiment.
Figure 2C:
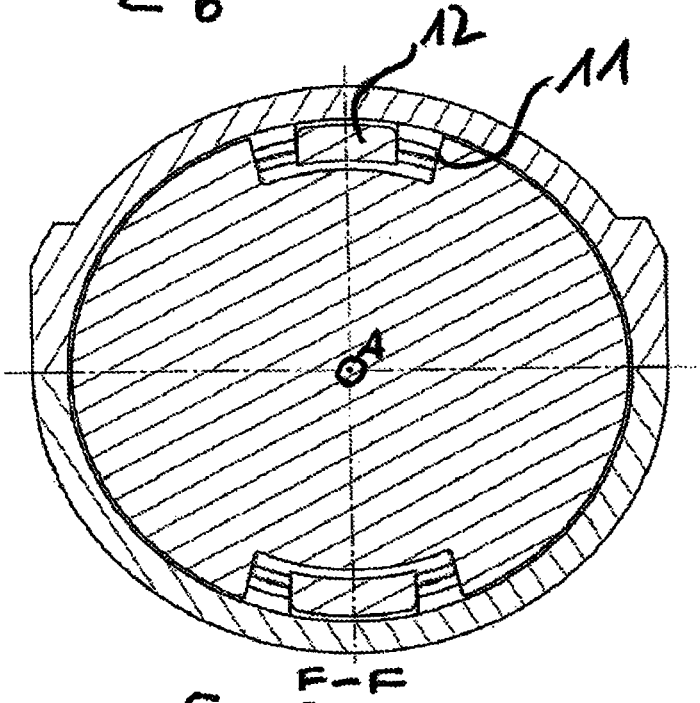
FIG. 2*c* shows the lock cylinder according to the first embodiment sectioned through line F-F in FIG. 2*b;*

As is shown in FIGS. 2*a*, 2*b* and 2*c*, cam portions 12 of the disengaging sleeve 6 here form a form closure with the openings 11 arranged on the bearing 8. In addition, recesses 13 and further openings 14, which likewise serve to receive the cam portions 12 of the disengaging sleeve 6, are arranged in the housing 2 of the lock cylinder 1. These measures bring about a further increase in the resistance moment by shearing of the cam portion 12 on the recess 13 and of the opening 14 in the housing 2, which resistance moment combats the torque which is generated due to a forcible rotation by a tool that engages the output element. Moreover, as a consequence of a form closure formed by the cam portion 12 received in the recess 13 and opening 14 in the housing 2, forced longitudinal movement of the disengaging sleeve 6 by an unauthorized user relative to the housing 2 is also prevented. As represented in FIG. 1*b*, the contact surfaces of the respective cam portions 12 and the respective contact surfaces of the bearing 8 are arranged substantially complementary to each other, wherein the contact surfaces are configured in cross section as inclined planes.

Figure 3A:
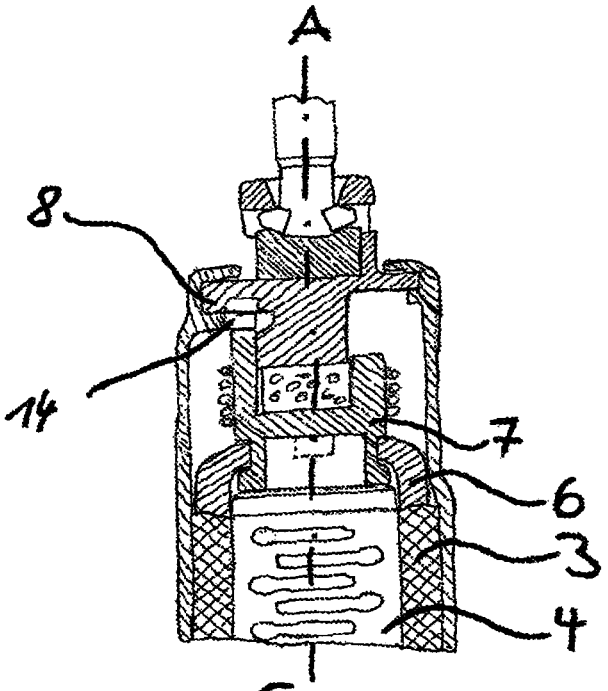
FIG. 3*a* shows the lock cylinder according to a second embodiment in case of a proper use.
Figure 3B:
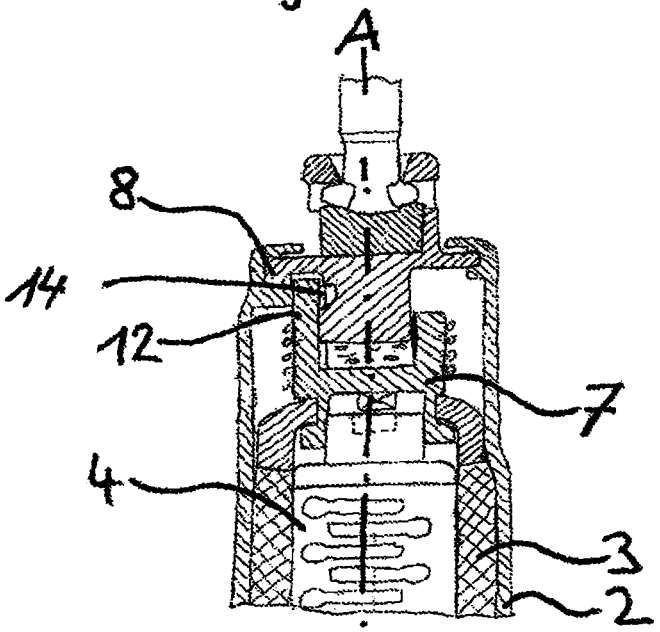
FIG. 3*b* shows the lock cylinder according to the second embodiment in case of an improper use.

A second illustrative embodiment of the lock cylinder 1 is shown in FIGS. 3*a* and 3*b*. The functionality of the lock cylinder is known from the prior art to the person skilled in the art and resembles the functionality described in the first illustrative embodiment. Unlike the first illustrative embodiment, the second illustrative embodiment shows that the cam portion 12 of a coupling element 7 forms a form closure with an opening 11 of the bearing 8, wherein in this illustrative embodiment the end of the cam portion 12 forms a form closure with the housing 2, in particular with an opening 14 arranged in the housing 2 (see FIG. 3*b*).

Figure 4A:
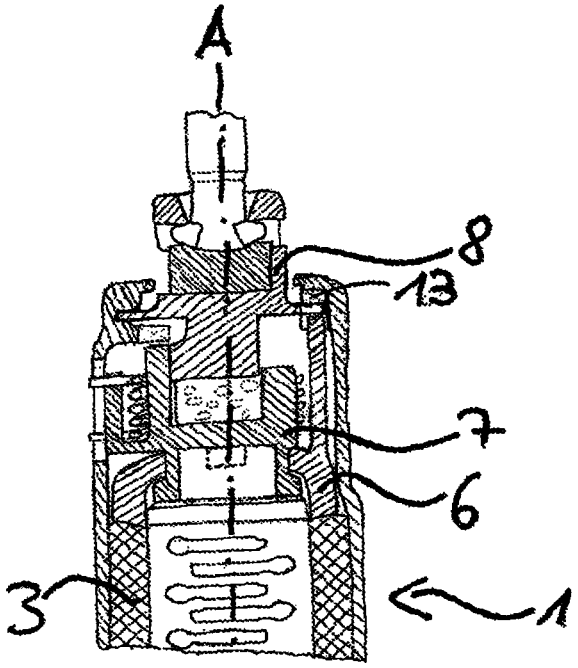
FIG. 4*a* shows the lock cylinder according to a third embodiment in case of a proper use.
Figure 4B:
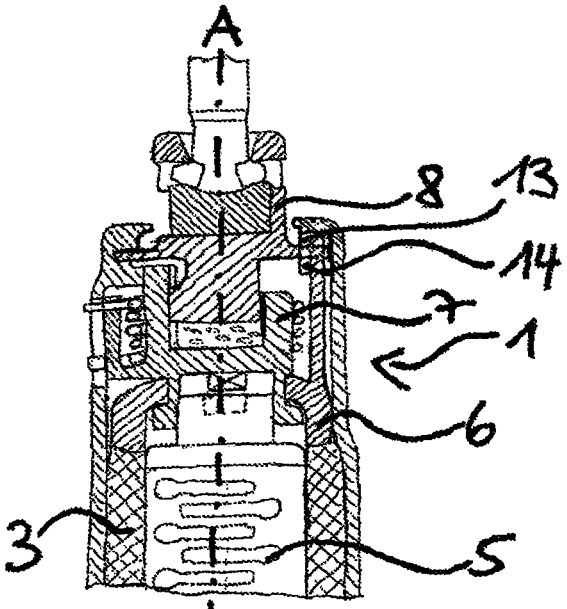
FIG. 4*b* shows the lock cylinder according to the third embodiment in case of an improper use.

In FIGS. 4*a* and 4*b*, a third embodiment of the lock cylinder 1 is represented, which lock cylinder is essentially a combination of the first and second illustrative embodiment. In addition to that form closure between bearing 8 and coupling element 7 which is shown in FIG. 3*b*, a form closure between the disengaging sleeve 6 and the housing 2, and the disengaging sleeve 6 with the bearing 8, is herein disclosed.

Within the scope of said illustrative embodiments, in particular with respect to the second and third illustrative embodiment, reference is made to DE 102009050905.4.

The invention claimed is:

1. A lock cylinder comprising:

a housing including a recess and an opening;

a first sleeve rotatably mounted in said housing and comprising a plurality of recesses;

a cylinder core accommodated in said sleeve and having spring-loaded tumblers engageable with said first sleeve, wherein engagement of said tumblers with said first sleeve resists rotation of said first sleeve in said housing;

a coupling element mounted in said housing;

a disengaging sleeve comprising a cam portion coupling said coupling element to said first sleeve; and a bearing rotatably fixed to said coupling element and supporting an output element and having an opening, wherein when a key is removed said spring-loaded tumblers engage said first sleeve forming a form closure, the disengaging sleeve forming a form closure between the cam portion and the opening in the bearing and between the cam portion and the recess in the housing and the opening in the housing to block rotation of the output element, the form closure shearing the cam portion on the opening in the housing and on the recess in the housing to increase a resistance moment that combats a torque generated by a forcible rotation of an improper object inserted in the cylinder core.

2. The lock cylinder as claimed in claim 1, in which the recess is a groove.

3. The lock cylinder as claimed in claim 1, in which a contact surface of the cam portion and a contact surface of the bearing are substantially complementary to each other.

4. The lock cylinder as claimed in claim 1, in which at least a portion of each of the contact surface of the cam portion and the contact surface of the bearing defines an inclined plane.

5. The lock cylinder as claimed in claim 1, in which the output element is an espagnolette.

6. The lock cylinder as claimed in claim 1, in which the housing is formed from two halves, and said first sleeve is held between said two halves.

7. The lock cylinder as claimed in claim 6, in which a longitudinal split in said housing defines said halves.

8. A lock cylinder comprising:

a housing including a recess and an opening:

a first sleeve rotatably mounted in said housing;

a cylinder core accommodated in said sleeve and having spring-loaded tumblers engageable with said first sleeve, wherein engagement of said tumblers with said first sleeve resists rotation of said first sleeve in said housing;

a coupling element mounted in said housing;

a second sleeve comprising a cam portion coupling said coupling element to said first sleeve; and a bearing rotatably fixed to said coupling element and having an opening, wherein when said tumblers engage said first sleeve forming a form closure, the second sleeve forming a form closure between the cam portion and the opening in the bearing and between the cam portion and the recess in the housing and the opening in the housing to block rotation, the form closure shearing the cam portion on the opening in the housing and on the recess in the housing to increase a resistance moment that combats a torque generated by a forcible rotation of an improper object inserted in the cylinder core.

9. The lock cylinder as claimed in claim 8, in which when said tumblers engage said first sleeve, one of said coupling element and said second sleeve engage said bearing to resist rotation, and when said tumblers disengage from said first sleeve, said at least one of said coupling element and said second sleeve disengage from said bearing to allow rotation of said output element.

10. The lock cylinder as claimed in claim 9, in which the bearing has at least one of a recess and opening engaging with a cam portion extending from said one of said coupling element and said second sleeve to resist said rotation of said output element.

11. The lock cylinder as claimed in claim 10, in which the housing has at least one of at least one opening and one recess engaging said cam portion, wherein said longitudinal movement of said second sleeve is resisted upon engagement of said cam portion with said at least one of at least one opening and one recess.

12. The lock cylinder as claimed in claim 8 in which the housing is formed from two halves, and said first sleeve is held between said two halves.

* * * * *